United States Patent [19]

Schamblin

[11] 3,962,693

[45] June 8, 1976

[54] MOTION DETECTION DEVICE INCLUDING A PENDULUM SWITCH

[76] Inventor: Charles H. M. Schamblin, P.O. Box 1709, Bakersfield, Calif. 93302

[22] Filed: July 21, 1975

[21] Appl. No.: 597,441

[52] U.S. Cl. ..... 340/261; 33/353; 200/61.45 M

[51] Int. Cl.[2] ..... G08B 13/08; G08B 17/00

[58] Field of Search ..... 200/61.45 M, 61.52, 200/61.45 R; 340/261, 65, 282, 283; 33/402, 366, 379, 353

[56] References Cited

UNITED STATES PATENTS

| | | | |
|---|---|---|---|
| 2,407,122 | 9/1946 | Young | 340/261 |
| 2,618,712 | 11/1952 | Moledzky | 340/261 |
| 2,813,941 | 11/1957 | Hollmig | 200/61.52 |
| 2,947,830 | 8/1960 | Goss | 340/65 |
| 3,054,096 | 9/1962 | Peritz | 200/61.45 R |
| 3,725,896 | 4/1973 | Wagner | 340/282 |

*Primary Examiner*—Glen R. Swann, III
*Attorney, Agent, or Firm*—Huebner & Worrel

[57] ABSTRACT

A motion detection device is characterized by an array of mutually spaced electrical contacts connected to one terminal of a pair of terminals having a voltage differential established therebetween, an electrically conductive first mass suspended between the pairs of contacts and connected to the other terminal of said pair, and a mass suspended from said first mass for damping pendulous motion of said first mass.

6 Claims, 3 Drawing Figures

MOTION DETECTION DEVICE INCLUDING A PENDULUM SWITCH

BACKGROUND OF THE INVENTION

1. Field of the Invention

The invention generally relates to accelerometers, and more particularly to a motion detection device, including a pendulum switch, having particular utility in burglar alarm systems and the like.

2. Description of the Prior Art

The prior art is, of course, replete with accelerometers adapted to detect motion imparted in given directions to given bodies, both bodies in motion and bodies at rest. Of course, the configuration and design of such devices vary substantially. However, motion detection devices relied upon for purposes of indicating the presence of intruders and the like normally include circuitry adapted to respond to an interruption of circuit continuity resulting from unauthorized entry, such as through a breaking of circuits painted on glass panes and the like. In most instances, motion detection devices suitably sensitive for detecting motion resulting from the presence of intruders gaining entry through stealth are relatively economically expensive to fabricate and are complicated to install and maintain.

As can be appreciated by owners of homes, small shops, and the like, it often is economically impractical to attempt to secure structures employing existing intruder detection systems having suitable sensitiveness for detecting intruders who do not literally break into the structure.

Furthermore, fire detection systems normally require heat-responsive devices adapted to be activated for indicating the existence of a detected fire. Such devices are used even though heated air currents normally are generated and attend fires occurring in buildings and the like, as a consequence of the air within the building being expanded, before the heat sensitive devices employed for detecting the existence of a fire are activated.

It is, therefore, the general purpose of the instant invention to provide a motion detection device, the sensitiveness of which can be adjusted, and which is economic to fabricate, simple to install and maintain and suitably sensitive for use in detecting motion of structure as well as streams of air within buildings and the like, whereby motion resulting from the presence of intruders, the existence of fires and similar catastrophic occurrences readily can be detected for providing an alarm.

OBJECTS AND SUMMARY OF THE INVENTION

It is an object of the instant invention to provide a motion detection device which overcomes the aforementioned difficulties and disadvantages.

It is another object to provide an improved motion detection device having general utility.

Another object of the instant invention is to provide a motion detection device which is economic to fabricate and simple to install and maintain in homes and shops and the like.

It is another object to provide a simple practical and economical detection motion device which can readily be employed in alarm systems for detecting intruders and the like.

It is another object to provide a motion detection device, the sensitivity of which is readily adjustable, suitable for detecting motion imparted to structure, air and the like, whereby motion attending catastrophic events occurring within buildings can be detected.

Another object of the invention is to provide a motion detection device which is particularly useful in connection with alarm systems such as burglar alarm systems, fire alarm systems, and the like, although not necessarily restricted thereto, since a device embodying the principles of the instant invention may be installed and employed for other purposes such as in systems employed for determining the tensile strength of cords and the like which impart motion, upon failure.

These and other objects and advantages are achieved through a use of a motion detection device having at least one pair of mutually spaced electrical contacts electrically connected to a common electrical terminal, comprising one of a pair of electrical terminals maintained at a potential difference, an electrically conductive first mass connected with the other terminal of said pair of terminals and suspended for pendulous motion between the contacts of said pair, and a second mass suspended from the first mass for damping pendulous motion imparted to the first mass, as will become more readily apparent by reference to the following description and claims in light of the accompanying drawings.

DESCRIPTION OF THE PREFERRED EMBODIMENT

Figure 1:
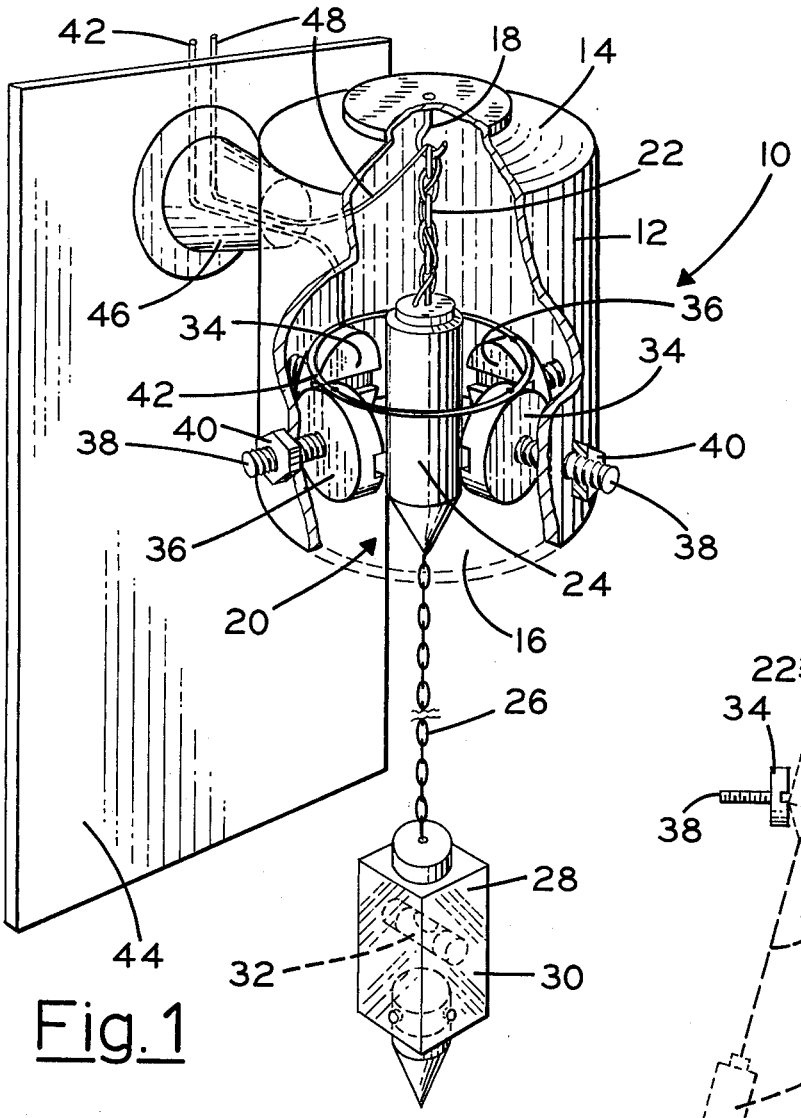
FIG. 1 is a fragmented perspective view of a motion detection device which embodies the principles of the instant invention.

Referring now with more particularity to the drawings, wherein like reference characters designate like or corresponding parts throughout the several views, there is shown in FIG. 1 a motion detection device generally designated 10.

As shown in FIG. 1, the device 10 includes a suitable housing 12. While not illustrated, it is to be understood that the housing may be formed of a dielectric material, such as a synthetic resin, or the like. The housing 12 is of a cylindrical configuration and includes a closure plate 14 extended across one end, serving as the uppermost end thereof and includes an opening 16 located at the end thereof opposite the closure plate.

Depending from the center portion of the closure plate 14 there is a hook 18 from which is suspended a motion detecting pendulum, generally designated 20. The pendulum 20 includes a first flexible member 22 formed of a nonferromagnetic material, such as a synthetic resin and the like. While, as shown, the member 22 assumes the configuration of a link chain, other configurations can be employed equally as well.

From the lowermost end of the first flexible member 22 there is suspended a first mass 24. The mass 24 includes a surface of a generally cylindrical configuration and is formed from an electrically conductive, ferromagnetic material such as steel and the like.

To the lowermost end of the first mass 24, opposite the first flexible member 22, there is attached a second flexible member 26. This member is formed of a material similar to that from which the first flexible member 22 is fabricated and serves to support, in suspension, a second mass 28. Preferably, the second mass 28 includes a transparent segment 30 having embedded therein a level 32, the purpose of which will hereinafter be more fully understood. The transparent segment of the second mass 28 preferably is formed from a synthetic resin, such as transparent polyvinyl chloride, and includes planar surfaces defining a surface area to be impacted by moving air and the like through which motion is imparted to the pendulum 20. However, the mass 28 also serves to act as a motion damping mass, through the second flexible member 26, on the first mass 24 for thus impeding pendulous motion imparted to the first mass. Thus the second mass not only functions to impart motion to the pendulum 20, but also serves to reduce the sensitiveness of the device.

Disposed within the housing 12 there is a first pair of electrical contacts 34 arranged in a coplanar relationship at opposite sides of the first mass 24, and a second pair of electrical contacts, designated 36, arranged in coplanar relation and disposed at opposite sides of the first mass 24. Of course, additional contacts can be employed where so desired. Each of the contacts 34 and 36 comprises a permanent magnet formed of electrically conductive material. Since such material is well known a detailed discussion thereof is omitted in the interest of brevity.

The contacts 34 and 36 are mounted on screw-threaded shafts 38 extended through screw-threaded openings tapped in the housing 12, whereby each of the contacts 34 and 36 may be adjustably repositioned radially with respect to the housing. As a practical matter, the shafts 38 also are of a dielectric material and a stop nut 40 is provided for securing each of the shafts in an adjusted relationship with the housing 12. Thus the contacts are electrically insulated from the housing and supported in an adjustable relationship with the first mass 24.

To each of the contacts 34 and 36 there is attached an electrical conductor 42. As a practical matter, the conductor 42 is attached by suitable means, including solder and the like, to the contacts 34 and 36. If so desired, screws seated in tapped openings can be employed for this purpose equally as well.

As illustrated in FIG. 1, the housing 12 is affixed to a panel 44 employing a stand-off 46 of a generally tubular configuration and of a suitable length. The stand-off 46 is welded, soldered, or otherwise rigidly secured to the housing 12 and to the panel whereby the panel 44 is caused to serve as a base through which the housing 12 is mounted in an operative environment.

Figure 2:
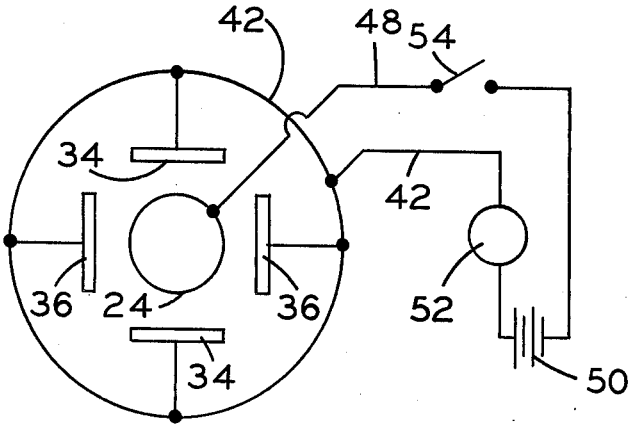
FIG. 2 is a diagrammatic view of the device shown in FIG. 1.

As illustrated in both FIGS. 1 and 2, an electrical conductor 48 is connected to the first mass 24, through any suitable means, and is threaded through the first flexible member 22 upwardly to the hook 18 and thence passed through the stand-off 46. It is, or course, highly desirable that the conductor be so connected to the mass 24 that pendulous motion of the pendulum 20 be unimpaired. Consequently, it will be appreciated that the electrical conductor 48 is suitably flexible and is passed through the hook 18 prior to being passed through the stand-off 46.

The conductors 42 and 48 are electrically connected to the opposite terminals of a source of electrical energy, such as an electric storage battery 50, FIG. 2. However, it is to be understood that a source of house current is employed where so desired. However, in such instances, it is deemed desirable to provide a step-down transformer so that only a low-voltage is applied across the device.

Within the conductor 42 there is connected an electrically energizable alarm device 52. This device is adapted to provide audible signals, when energized in response to a passage of electrical current therethrough. Of course, such devices are well known and are readily available in the market place. Accordingly, a detailed description of the alarm device 52 is omitted in the interest of brevity. However, it should also be apparent that in lieu of an alarm adapted to provide audible signals, an alarm device adapted to provide visually detectable signals, such as red light, is employed, where so desired. As a practical matter, an on-off switch 54 also is connected within the electrical conductor 48 for purposes of selectively de-energizing the device 52.

Figure 3:
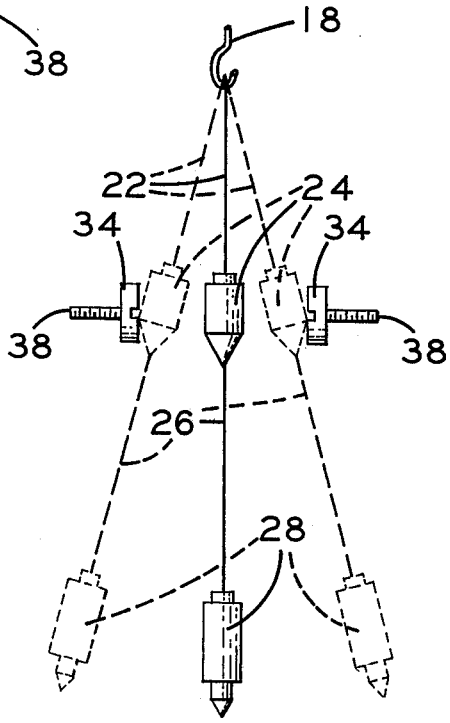
FIG. 3 is a diagrammatic view schematically illustrating the operation of the device shown in FIG. 1.

Preparatory to operation, the panel 44 is rigidly affixed to a selected surface, such as the surface of a wall, door, or the like of a given building. Prior to mounting the panel 44, the relationship of the contacts 34 and 36, relative to the housing 12, is established with approximate accuracy. Once the device 10 is mounted for operation, the conductors 42 and 48 are connected with the terminals of the battery 50 while the switch 54 remains open. Upon connecting the electrical conductors 42 and 48 to the battery 50, the switch 54 is closed so that a potential difference is established between the contacts 34 and the first mass 24. The sensitiveness of the device, in a given direction, is established by repositioning the contacts 34 and 36, within the housing 12 relative to a vertical centerline. The sensitiveness of the device is proportional to the distance through which the mass 28 must travel from a rest position in order for the mass 24 to engage the contacts, as depicted in FIG. 3. The rest position for the mass 28 is the position assumed by the mass 28 when the masses 24 and 28 are arranged in vertical alignment. Since the masses 24 and 28 are pendulous masses, there is a tendency for both of these masses to remain in continuous motion. Thus it is assured that the adjustment of contacts 34 and 36 is made relative to mass 24 in its rest position, even if mass 28 is hand-held during this adjustment.

OPERATION

It is believed that in view of the foregoing description, the operation of the device will readily be understood and it will be briefly reviewed at this point.

With the motion detection device 10 mounted and adjusted in the manner hereinbefore described, the device is prepared for operation. Where the motion detection device 10 is mounted on a door to be opened by an intruder, little difficulty is encountered in causing the pendulum 20 to experience sufficient motion for bringing the mass 24 into engagement with one or more of the contacts 34 or 36 in order that an electrical circuit is completed between the terminals of the battery 50, through an engagement of the mass 24 with the contacts 34 and/or 36.

In instances where the device is to be employed in detecting motion resulting from currents of moving air, the surfaces of the transparent segment 30 of the mass 28 are suitably dimensioned so that as currents of air are generated through motion within the building, pendulous motion is imparted thereto. In such instances the contacts 34 and 36 are suitably positioned to engage the mass 24 as a minimal pendulous motion is imparted to the mass. In view of the magnetic nature of the contacts, relative motion between the mass 24 and the contact ceases as the mass engages the contact. Thus chatter therebetween is avoided.

Of course, since air currents are generated by mechanisms other than intruders, such as by fire and the like, the device also is suitable for use for purposes other than detecting intruders.

Similarly, where desired, the device 10 is utilized to detect tensile strength in members interposed between the masses 24 and 28, since an elongation or separation of such members inherently serve to impart motion to the mass 24.

In view of the foregoing, it should readily be apparent that the device which embodies the principles of the instant invention provides a practical solution to the perplexing problem of providing a practical and economic motion detection device, particularly suited for use by home and shop owners in systems provided for detecting intruders, fire, and the like.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. A motion detection device comprising:

A. a pair of electrical terminals having a potential difference established therebetween;

B. a multiplicity of pairs of mutually spaced electrical contacts arranged in intersecting planes and commonly connected to one electrical terminal of said pair of electrical terminals;

C. an electrically conductive, first pendulous mass connected with the other terminal of said pair of terminals suspended for pendulous motion between said multiplicity of pairs of contacts and adapted to engage the contacts for thus establishing electrical continuity between the pair of terminals; and D. a second pendulous mass suspended from said first pendulous mass for damping pendulous motion imparted thereto having means including a level for indicating the instantaneous position of the masses relative to a vertical plane projected substantially midway between at least one pair of contacts.

2. The device of claim 1 wherein each of said contacts comprises means characterized by an external magnetic field.

3. The device of claim 1 further comprising an electrically energizable alarm connected in circuit series between said first pendulous mass and the other terminal of said pair of terminals.

4. The device of claim 1 further comprising means for repositioning said contacts relative to said plane passing vertically therebetween.

5. The device of claim 3 wherein said alarm comprises means for generating an audible signal.

6. The device of claim 5 further comprising means adapted to mount said device on structure.

* * * * *